US008041569B2

(12) United States Patent
Okutani et al.

(10) Patent No.: US 8,041,569 B2
(45) Date of Patent: Oct. 18, 2011

(54) SPEECH SYNTHESIS METHOD AND APPARATUS USING PRE-RECORDED SPEECH AND RULE-BASED SYNTHESIZED SPEECH

(75) Inventors: Yasuo Okutani, Kawasaki (JP); Michio Aizawa, Yokohama (JP); Toshiaki Fukada, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 859 days.

(21) Appl. No.: 12/035,789

(22) Filed: Feb. 22, 2008

(65) Prior Publication Data

US 2008/0228487 A1 Sep. 18, 2008

(30) Foreign Application Priority Data

Mar. 14, 2007 (JP) ..... 2007-065780

(51) Int. Cl.
*G10L 13/00* (2006.01)
*G10L 13/08* (2006.01)

(52) U.S. Cl. ..... 704/258; 704/260; 704/267

(58) Field of Classification Search ..... 704/258–269
See application file for complete search history.

(56) References Cited

U.S. PATENT DOCUMENTS

| | | | | |
|---|---|---|---|---|
| 5,745,651 | A | 4/1998 | Otsuka et al. | 395/2.77 |
| 5,913,193 | A * | 6/1999 | Huang et al. | 704/258 |
| 5,930,755 | A * | 7/1999 | Cecys | 704/260 |
| 6,175,821 | B1 * | 1/2001 | Page et al. | 704/258 |
| 6,253,182 | B1 * | 6/2001 | Acero | 704/268 |
| 6,266,637 | B1 * | 7/2001 | Donovan et al. | 704/258 |
| 6,308,156 | B1 * | 10/2001 | Barry et al. | 704/268 |
| 6,345,250 | B1 * | 2/2002 | Martin | 704/260 |
| 6,980,955 | B2 | 12/2005 | Okutani et al. | 704/258 |
| 7,039,588 | B2 | 5/2006 | Okutani et al. | 704/258 |
| 7,054,814 | B2 | 5/2006 | Okutani et al. | 704/256.4 |
| 7,260,533 | B2 | 8/2007 | Kamanaka | |
| 7,277,855 | B1 * | 10/2007 | Acker et al. | 704/260 |
| 7,742,921 | B1 * | 6/2010 | Davis et al. | 704/270 |
| 2002/0103648 | A1 * | 8/2002 | Case et al. | 704/260 |
| 2002/0193996 | A1 * | 12/2002 | Squibbs et al. | 704/260 |
| 2003/0158734 | A1 | 8/2003 | Cruickshank | 704/260 |

(Continued)

FOREIGN PATENT DOCUMENTS

| | | |
|---|---|---|
| EP | 1 511 008 A1 | 2/2005 |
| JP | 2002-221980 | 8/2002 |

(Continued)

OTHER PUBLICATIONS

Lee et al., "A Text-to-Speech Platform for Variable Length Optimal Unit Searching Using Perception Based Cost Functions", *International Journal of Speech Technology*, vol. 6, pp. 347-356 (2003).

(Continued)

*Primary Examiner* — James S. Wozniak
*Assistant Examiner* — Jialong He
(74) *Attorney, Agent, or Firm* — Fitzpatrick, Cella, Harper & Scinto

(57) ABSTRACT

A language processing unit identifies a word by performing language analysis on a text supplied from a text holding unit. A synthesis selection unit selects speech synthesis processing performed by a rule-based synthesis unit or speech synthesis processing performed by a pre-recorded-speech-based synthesis unit for a word of interest extracted from the language analysis result. The selected rule-based synthesis unit or pre-recorded-speech-based synthesis unit executes speech synthesis processing for the word of interest.

4 Claims, 15 Drawing Sheets

U.S. PATENT DOCUMENTS

| | | | | |
|---|---|---|---|---|
| 2003/0177010 | A1* | 9/2003 | Locke | 704/260 |
| 2003/0187651 | A1* | 10/2003 | Imatake | 704/269 |
| 2003/0229496 | A1 | 12/2003 | Yamada et al. | 704/258 |
| 2004/0254792 | A1* | 12/2004 | Busayapongchai et al. | 704/260 |
| 2005/0114137 | A1* | 5/2005 | Saito et al. | 704/260 |
| 2005/0137870 | A1* | 6/2005 | Mizutani et al. | 704/264 |
| 2005/0209855 | A1 | 9/2005 | Okutani et al. | 704/256.4 |
| 2005/0288929 | A1 | 12/2005 | Kuboyama et al. | 704/251 |
| 2008/0270140 | A1* | 10/2008 | Hertz et al. | 704/267 |

OTHER PUBLICATIONS

Stöber et al., "Synthesis by Word Concatenation", in Proceedings of the European Conference on Speech Communication and Technology (Budapest, Hungary), 1999, vol. 2, pp. 619-622.

Extended European search report dated Jun. 27, 2008, issued in Application No. EP 08003590.

* cited by examiner

SPEECH SYNTHESIS METHOD AND APPARATUS USING PRE-RECORDED SPEECH AND RULE-BASED SYNTHESIZED SPEECH

BACKGROUND OF THE INVENTION

1. Field of the Invention

The present invention relates to a speech synthesis technique.

2. Description of the Related Art

For train guidance on station platforms, traffic jam information on expressways, and the like, domain-specific synthesis is used, which combines and concatenates pre-recorded speech data (pre-stored word speech data and phrase speech data). This scheme can obtain synthetic speech with high naturalness because the technique is applied to a specific domain, but cannot synthesize speech corresponding to arbitrary texts.

A concatenative synthesis system, which is a typical rule-based speech synthesis system, generates rule-based synthetic speech by dividing an input text into words, adding pronunciation information to them, and concatenating the speech segments in accordance with the pronunciation information. Although this scheme can synthesize speech corresponding to arbitrary texts, the naturalness of synthetic speech is not high.

Japanese Patent Laid-Open No. 2002-221980 discloses a speech synthesis system which generates synthetic speech by combining pre-recorded speech and rule-based synthetic speech. This system comprises a phrase dictionary holding pre-recorded speech and a pronunciation dictionary holding pronunciations and accents. Upon receiving an input text, the system outputs pre-recorded speech of a word when it is registered in the phrase dictionary, and outputs rule-based synthetic speech of a word which is generated from the pronunciation and accent of the word when it is registered in the pronunciation dictionary.

In speech synthesis disclosed in Japanese Patent Laid-Open No. 2002-221980, since voice quality greatly changes near the boundary between pre-recorded speech and rule-based synthetic speech, the intelligibility may deteriorate.

SUMMARY OF THE INVENTION

The present invention has been made in consideration of the above problem, and has as its object to improve intelligibility when synthetic speech is generated by combining pre-recorded speech and rule-based synthetic speech.

According to one aspect of the present invention, a speech synthesis apparatus includes a language analysis unit configured to identify a word by performing language analysis on a supplied text, a selection unit configured to select one of first speech synthesis processing of performing rule-based synthesis based on a result of the language analysis and second speech synthesis processing of performing pre-recorded-speech-based synthesis for playing back pre-recorded speech data as speech synthesis processing to be executed for a word of interest which is extracted from the result of the language analysis, wherein the selection unit selects the first or second speech synthesis processing based on a word adjacent to the word of interest, a process execution unit configured to execute the first or second speech synthesis processing, which is selected by the selection unit, for the word of interest, and an output unit configured to output synthetic speech generated by the process execution unit.

Another aspect of the present invention, a speech synthesis method includes a language analysis step of identifying a word by performing language analysis on a supplied text, a selection step of selecting one of first speech synthesis processing of performing rule-based synthesis based on a result of the language analysis and second speech synthesis processing of performing pre-recorded-speech-based synthesis for playing back pre-recorded speech data as speech synthesis processing to be executed for a word of interest which is extracted from the result of the language analysis, wherein the selection step selects the first or second speech synthesis processing based on a word adjacent to the word of interest, a process execution step of executing the first or second speech synthesis processing, which is selected in the selection step, for the word of interest, and an output step of outputting synthetic speech generated in the process execution step.

Further features of the present invention will become apparent from the following description of exemplary embodiments with reference to the attached drawings.

DESCRIPTION OF THE EMBODIMENTS

Various exemplary embodiments, features, and aspects of the present invention will be described in detail below with reference to the drawings. The present invention is not limited by the disclosure of the embodiments and all combinations of the features described in the embodiments are not always indispensable to solving means of the present invention.

The following embodiments exemplify a case in which a term registered in a language dictionary used for language analysis for rule-based synthesis or registered in pre-recorded speech data for pre-recorded-speech-based synthesis is a word. However, the present invention is not limited to this. A registered term can be a phrase comprising a plurality of word strings or a unit smaller than a word.

First Embodiment

Figure 1:
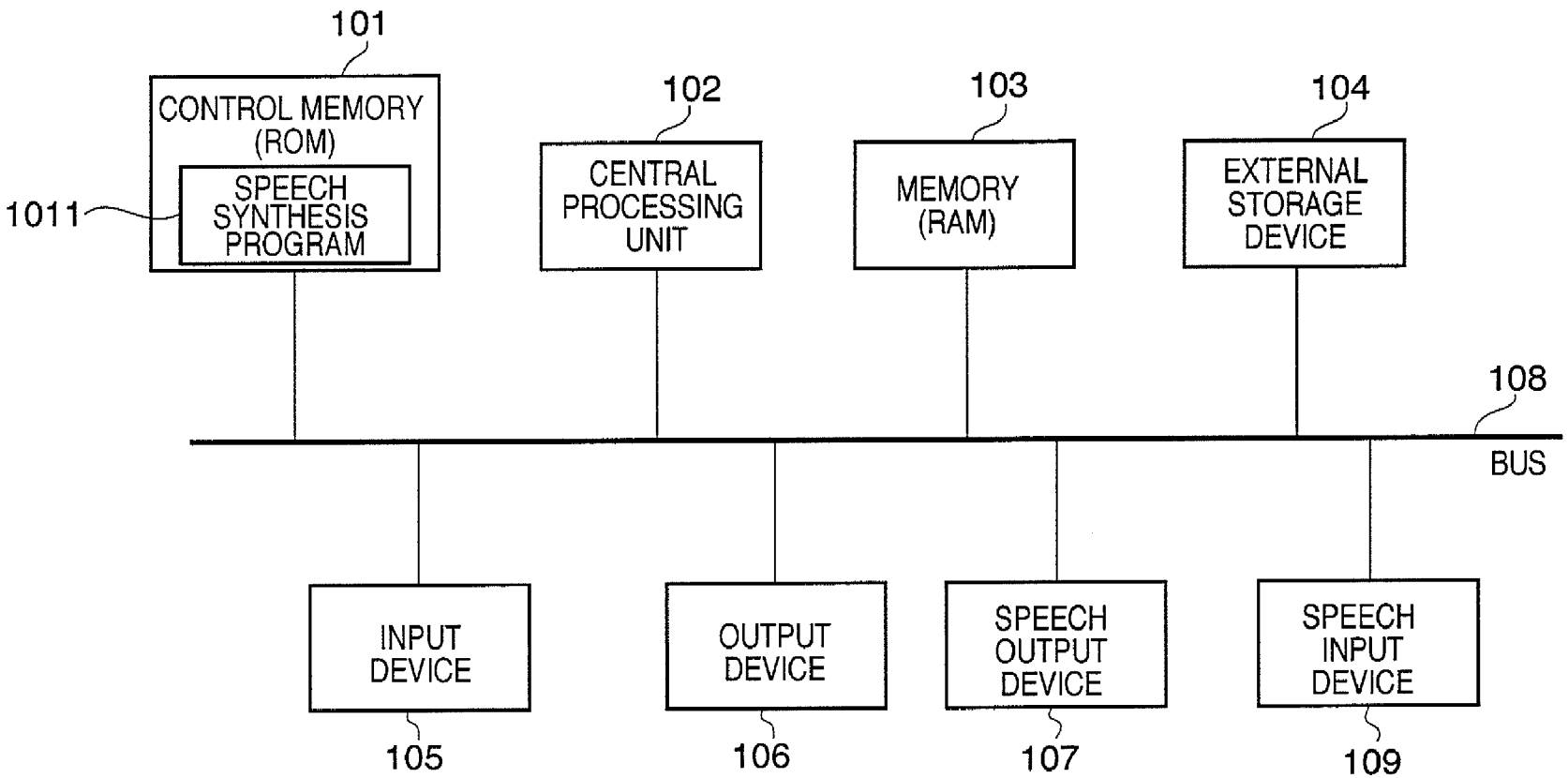
FIG. 1 is a block diagram showing the hardware arrangement of a speech synthesis apparatus according to the first embodiment.

FIG. 1 is a block diagram showing the hardware arrangement of a speech synthesis apparatus according to the first embodiment.

Referring to FIG. 1, reference numeral 101 denotes a control memory (ROM) storing a speech synthesis program 1011 according to this embodiment and permanent data; 102, a central processing unit which performs processing such as numerical processing/control; 103, a memory (RAM) for storing temporary data; 104, an external storage device; 105, an input device which is used by a user to input data to this apparatus and issue operation instructions thereto; 106, an output device such as a display device, which presents various kinds of information to the user under the control of the central processing unit 102; 107, a speech output device which outputs speech; 108, a bus via which the respective devices exchange data; and 109, a speech input device which is used by the user to input speech to this apparatus.

Figure 2:
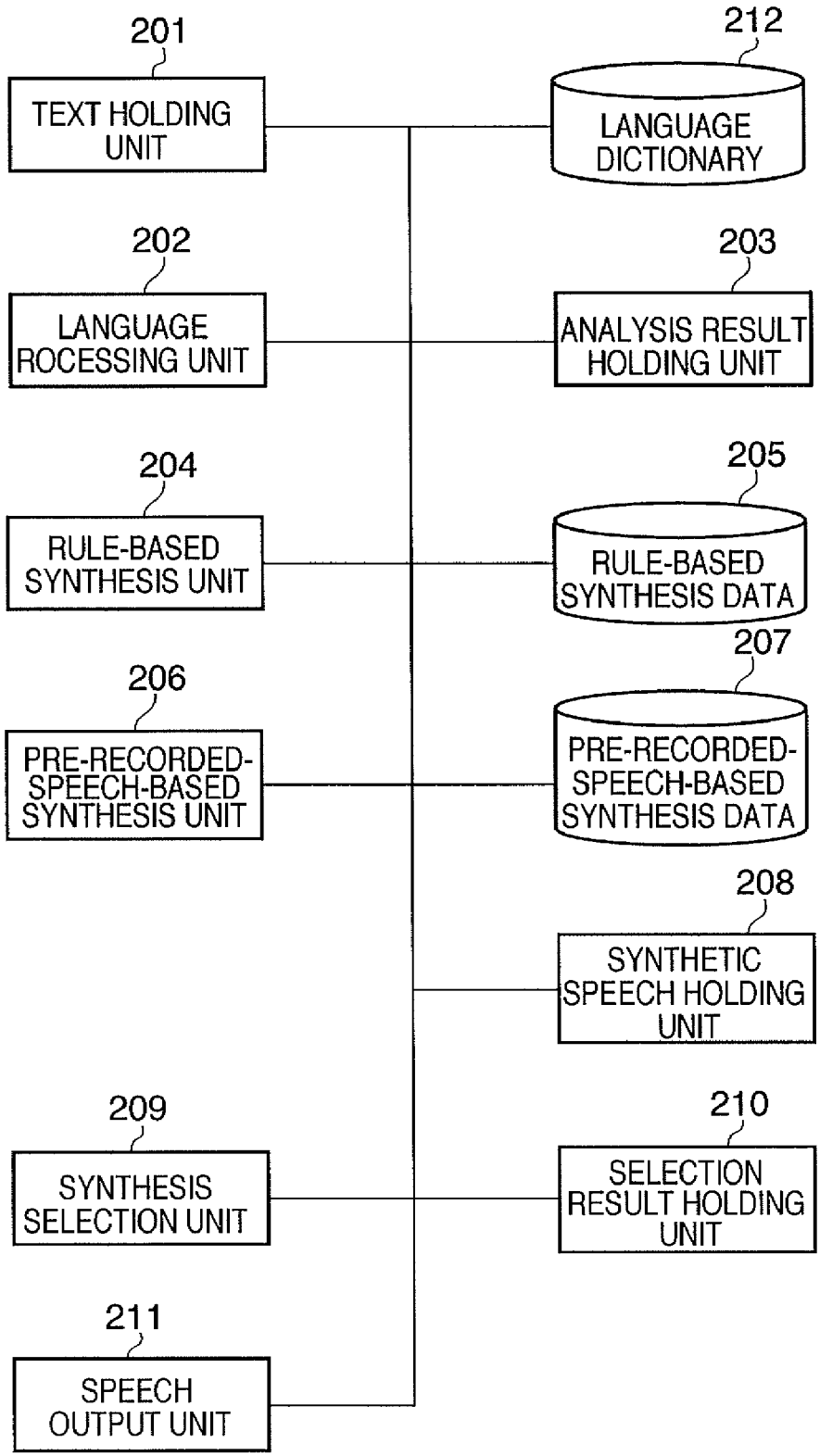
FIG. 2 is a block diagram showing the module arrangement of the speech synthesis apparatus according to the first embodiment.

FIG. 2 is a block diagram showing the module arrangement of the speech synthesis apparatus according to this embodiment.

Referring to FIG. 2, a text holding unit 201 holds an input text as a speech synthesis target. A language processing unit 202 as a language analysis unit identifies the words of the text supplied from the text holding unit 201 by executing language analysis using a language dictionary 212. With this operation, words as speech synthesis processing targets are extracted, and information necessary for speech synthesis processing is generated. An analysis result holding unit 203 holds the analysis result obtained by the language processing unit 202. A rule-based synthesis unit 204 performs rule-based synthesis (first speech synthesis processing) based on the analysis result held by the analysis result holding unit 203. Rule-based synthesis data 205 comprises a rule and unit segment data necessary for the execution of rule-based synthesis by the rule-based synthesis unit 204. A pre-recorded-speech-based synthesis unit 206 performs pre-recorded-speech-based synthesis (second speech synthesis processing) to play back pre-recorded speech data based on the analysis result held by the analysis result holding unit 203. Pre-recorded-speech-based synthesis data 207 is the pre-recorded speech data of words or phrases necessary for the execution of pre-recorded-speech-based synthesis by the pre-recorded-speech-based synthesis unit 206. A synthetic speech holding unit 208 holds the synthetic speech obtained by the rule-based synthesis unit 204 or the pre-recorded-speech-based synthesis unit 206.

A synthesis selection unit 209 selects a speech synthesis method (rule-based synthesis or pre-recorded-speech-based synthesis) to be applied to a word of interest based on the analysis result held by the analysis result holding unit 203 and the previous selection result held by a selection result holding unit 210. The selection result holding unit 210 holds the speech synthesis method for the word of interest, which is selected by the synthesis selection unit 209, together with the previous result. A speech output unit 211 outputs, via the speech output device 107, the synthetic speech held by the synthetic speech holding unit 208. The language dictionary 212 holds the spelling information, pronunciation information, and the like of words.

Pre-recorded-speech-based synthesis in this method is a method of generating synthetic speech by combining pre-recorded speech data such as pre-recorded words and phrases. Needless to say, pre-recorded speech data can be processed or output without any processing when they are combined.

Figure 3:
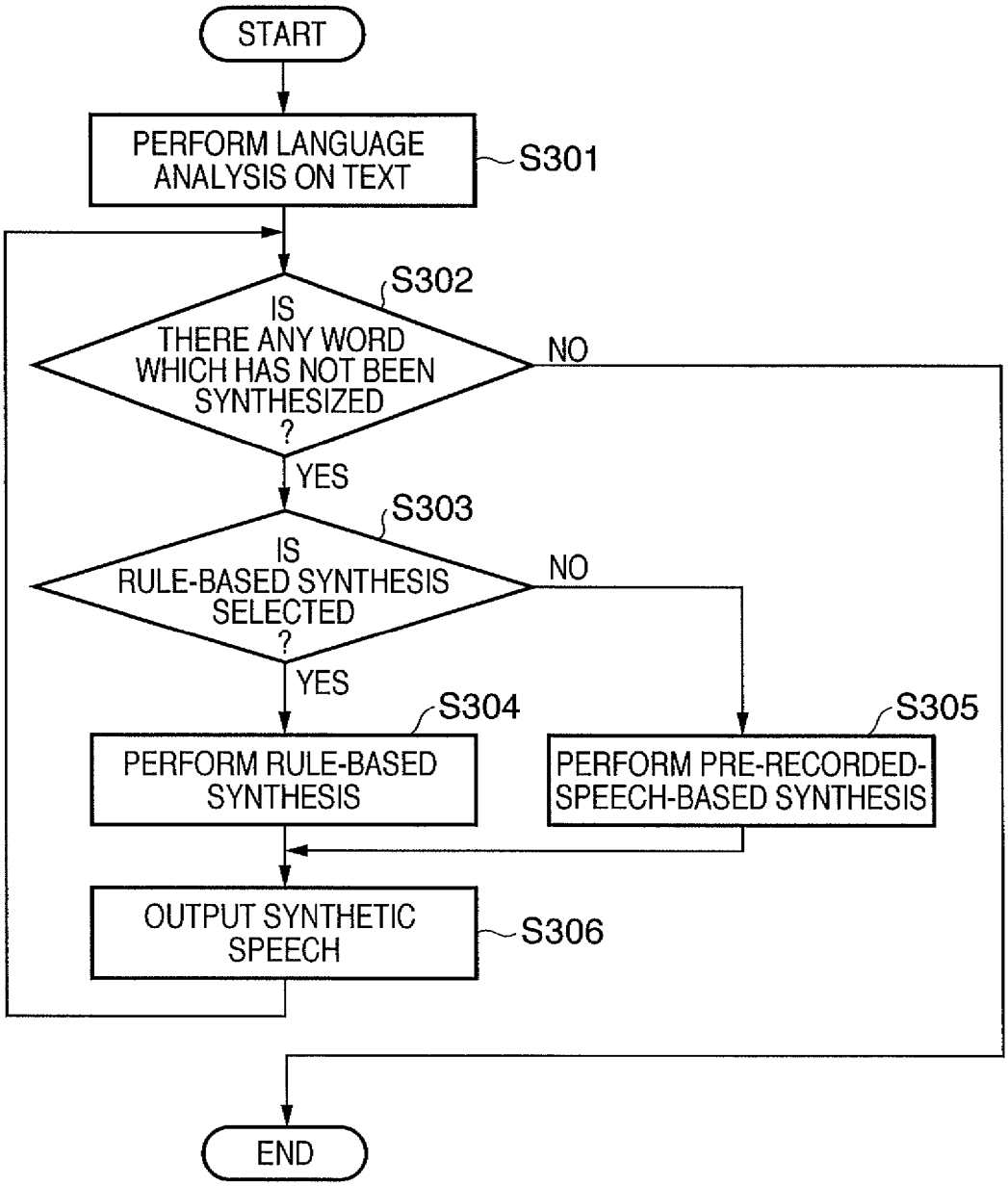
FIG. 3 is a flowchart showing processing in the speech synthesis apparatus according to the first embodiment.

FIG. 3 is a flowchart showing processing in the speech synthesis apparatus according to this embodiment.

In step S301, the language processing unit 202 extracts a word as a speech synthesis target by performing language analysis on a text as a synthesis target held by the text holding unit 201 by using the language dictionary 212. This embodiment is premised on the procedure of sequentially performing speech synthesis processing from the start of a text. For this reason, words are sequentially extracted from the start of a text. In addition, pronunciation information is added to each word, and information indicating whether there is pre-recorded speech corresponding to each word is extracted from the pre-recorded-speech-based synthesis data 207. The analysis result holding unit 203 holds the analysis result. The process then shifts to step S302.

If it is determined in step S302 that the analysis result held by the analysis result holding unit 203 contains a word which has not been synthesized, the process shifts to step S303. If the analysis result contains no word which has not been synthesized, this processing is terminated.

In step S303, the synthesis selection unit 209 selects a speech synthesis method for the word of interest (the first word) based on the analysis result held by the analysis result holding unit 203 and the speech synthesis method selection results on previously processed words which are held by the selection result holding unit 210. The selection result holding unit 210 holds this selection result. If rule-based synthesis is selected as a speech synthesis method, the process shifts to step S304. If pre-recorded-speech-based synthesis is selected as a speech synthesis method instead of rule-based synthesis, the process shifts to step S305.

In step S304, the rule-based synthesis unit 204 as a process execution unit performs rule-based synthesis for the word of interest by using the analysis result held by the analysis result holding unit 203 and the rule-based synthesis data 205. The synthetic speech holding unit 208 holds the generated synthetic speech. The process then shifts to step S306.

In step S305, the pre-recorded-speech-based synthesis unit 206 as a process execution unit performs pre-recorded-speech-based synthesis for the word of interest by using the analysis result held by the analysis result holding unit 203 and the pre-recorded-speech-based synthesis data 207. The synthetic speech holding unit 208 holds the generated synthetic speech. The process then shifts to step S306.

In step S306, the speech output unit 211 outputs, via the speech output device 107, the synthetic speech held by the synthetic speech holding unit 208. The process returns to step S302.

The following is a selection criterion for a speech synthesis method in step S303 in this embodiment.

Priority is given first to the pre-recorded-speech-based synthesis scheme. In other cases, the same speech synthesis method as that selected for a word (second word) adjacent to the word of interest, e.g., a word immediately preceding the word of interest, is preferentially selected. If no pre-recorded speech of the word of interest is registered, pre-recorded-speech-based synthesis cannot be performed. In this case, therefore, rule-based synthesis is selected. Rule-based synthesis can generally synthesize an arbitrary word, and hence can always be selected.

According to the above processing, a speech synthesis method for the word of interest is selected in accordance with a speech synthesis method for a word immediately preceding the word of interest. This makes it possible to continuously use the same speech synthesis method and suppress the number of times of switching of the speech synthesis methods. This allows to expect an improvement in the intelligibility of synthetic speech.

Second Embodiment

In the first embodiment described above, the same speech synthesis method as that selected for a word immediately preceding a word of interest is preferentially selected for the word of interest. In contrast to this, the second embodiment sets the minimization of concatenation distortion as a selection criterion. This will be described in detail below.

Figure 4:
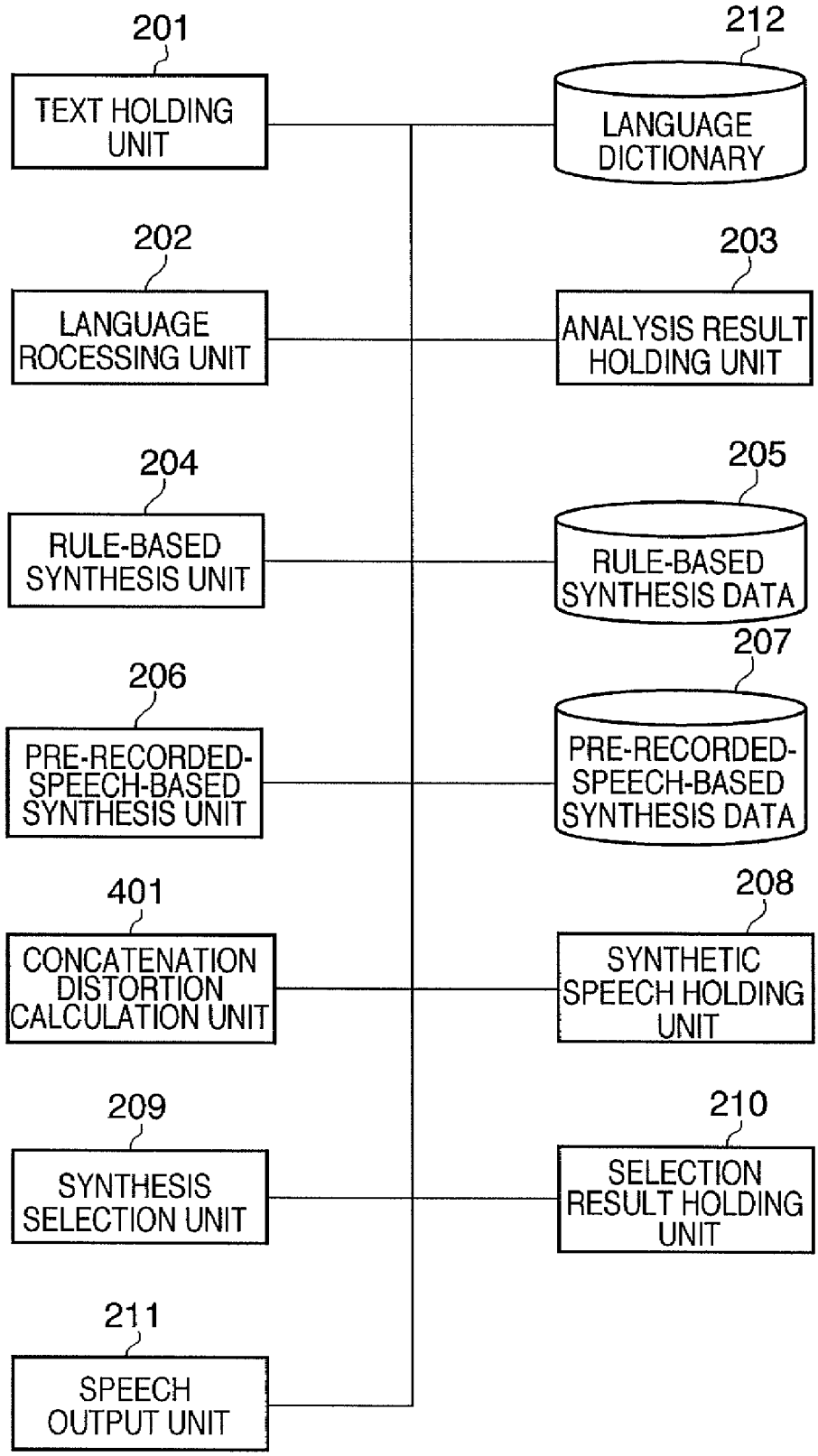
FIG. 4 is a block diagram showing the module arrangement of a speech synthesis apparatus according to the second embodiment.

FIG. 4 is a block diagram showing the module arrangement of a speech synthesis apparatus according to the second embodiment.

The same reference numerals as in FIG. 4 denote modules which perform the same processing as in the first embodiment in FIG. 2, and a repetitive description will be omitted. FIG. 4 shows an arrangement additionally including a concatenation distortion calculation unit 401 as compared with the arrangement shown in FIG. 2. The concatenation distortion calculation unit 401 calculates the concatenation distortion between the synthetic speech of a word immediately preceding a word of interest, which is held by a synthetic speech holding unit 208, and synthesis candidate speech of the word of interest. The synthetic speech holding unit 208 holds the synthetic speech obtained by a rule-based synthesis unit 204 or pre-recorded-speech-based synthesis unit 206 until a speech synthesis method for the next word is selected. A synthesis selection unit 209 selects synthesis candidate speech for which the concatenation distortion calculation unit 401 has calculated minimum concatenation distortion and a speech synthesis method corresponding to it. A selection result holding unit 210 holds the synthesis candidate speech and the speech synthesis method corresponding to it.

A processing procedure in the speech synthesis apparatus according to this embodiment will be described with reference to FIG. 3 in the first embodiment. Note that the processing procedure except for step S303 is the same as that in the first embodiment, and hence a repetitive description will be omitted.

In step S303, the concatenation distortion calculation unit 401 calculates the concatenation distortion between the synthetic speech of a word immediately preceding a word of interest, which is held by the synthetic speech holding unit 208, and synthesis target speech of the word of interest. The synthesis selection unit 209 then selects synthesis candidate speech for which the concatenation distortion calculation unit 401 has calculated minimum concatenation distortion and a speech synthesis method corresponding to it. The selection result holding unit 210 holds this selection result. If the selected speech synthesis method is rule-based synthesis, the process shifts to step S304. If the selected speech synthesis method is not rule-based synthesis but is pre-recorded-speech-based synthesis, the process shifts to step S305.

Figure 5:
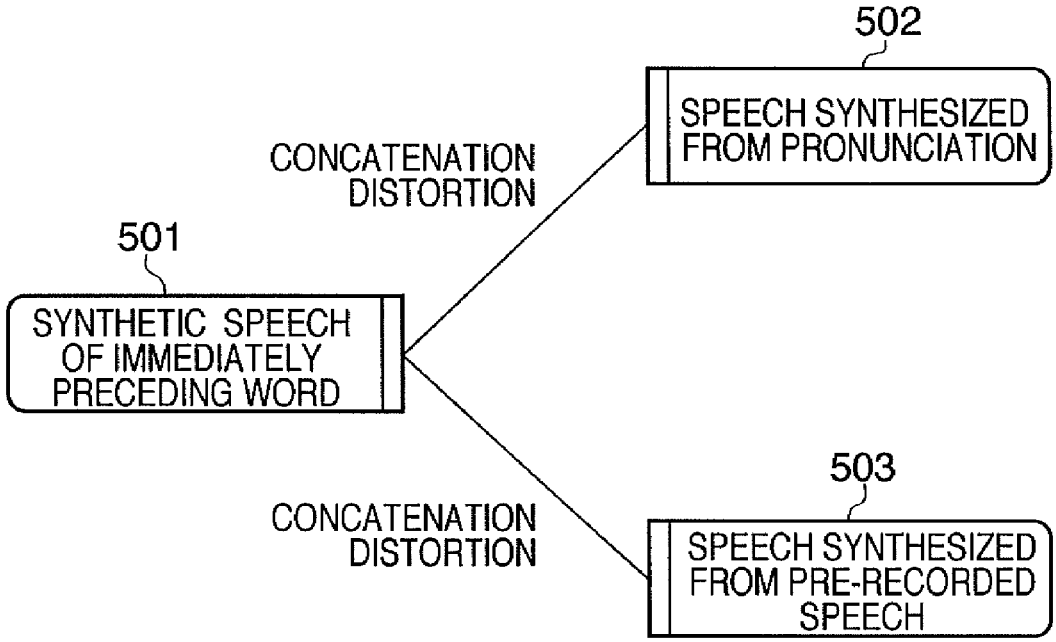
FIG. 5 is a schematic view for explaining concatenation distortion in the second embodiment.

FIG. 5 is a schematic view for explaining concatenation distortion in the second embodiment.

Referring to FIG. 5, reference numeral 501 denotes the synthetic speech of a word immediately preceding a word of interest; 502, synthesis candidate speech obtained by applying rule-based synthesis to the pronunciation of the word of interest; and 503, synthesis candidate speech obtained by applying pre-recorded-speech-based synthesis to pre-recorded speech.

Concatenation distortion in this embodiment is the spectral distance between the end of the synthetic speech of a word immediately preceding a word of interest and the start of synthetic speech of the word of interest. The concatenation distortion calculation unit 401 calculates the concatenation distortion between the synthetic speech 501 of the immediately preceding word and the synthesis candidate speech (speech synthesized from a pronunciation) 502 obtained by rule-based synthesis of the word of interest and the concatenation distortion between the synthetic speech 501 of the immediately preceding word and the synthesis candidate speech 503 obtained by pre-recorded-speech-based synthesis. The synthesis selection unit 209 selects synthesis candidate speech which minimizes concatenation distortion and a speech synthesis method for it.

Obviously, concatenation distortion is not limited to a spectral distance, and can be defined based on an acoustic feature amount typified by a cepstral distance or a fundamental frequency, or by using another known technique. Consider, for example, a speaking rate. In this case, concatenation distortion can be defined based on the difference or ratio between the speaking rate of an immediately preceding word and the speaking rate of synthesis candidate speech. If the speaking rate difference is defined as concatenation distortion, it can be defined that the smaller the difference, the smaller the concatenation distortion. When the speaking rate ratio is defined as concatenation distortion, it can be defined that the smaller difference between the speaking rate ratio and a reference ratio of 1, the smaller the concatenation distortion. In other words, it can be defined that the smaller the distance of a speaking rate ratio from a reference ratio of 1, the smaller the concatenation distortion.

As described above, if there are a plurality of synthesis candidate speech data for a word of interest, setting the minimization of concatenation distortion as a selection criterion makes it possible to select synthesis candidate speech with smaller distortion at a concatenation point and a speech synthesis method for it. This allows to expect an improvement in intelligibility.

Third Embodiment

The first and second embodiments are configured to select a speech synthesis method word by word. However, the present invention is not limited to this. For example, it suffices to select synthesis candidate speech of each word and a speech synthesis method for it so as to satisfy a selection criterion for all or part of a supplied text.

The first and second embodiments are based on the premise that the language processing unit 202 uniquely identifies a word. However, the present invention is not limited to this. An analysis result can contain a plurality of solutions. This embodiment exemplifies a case in which there are a plurality of solutions.

Figure 6:
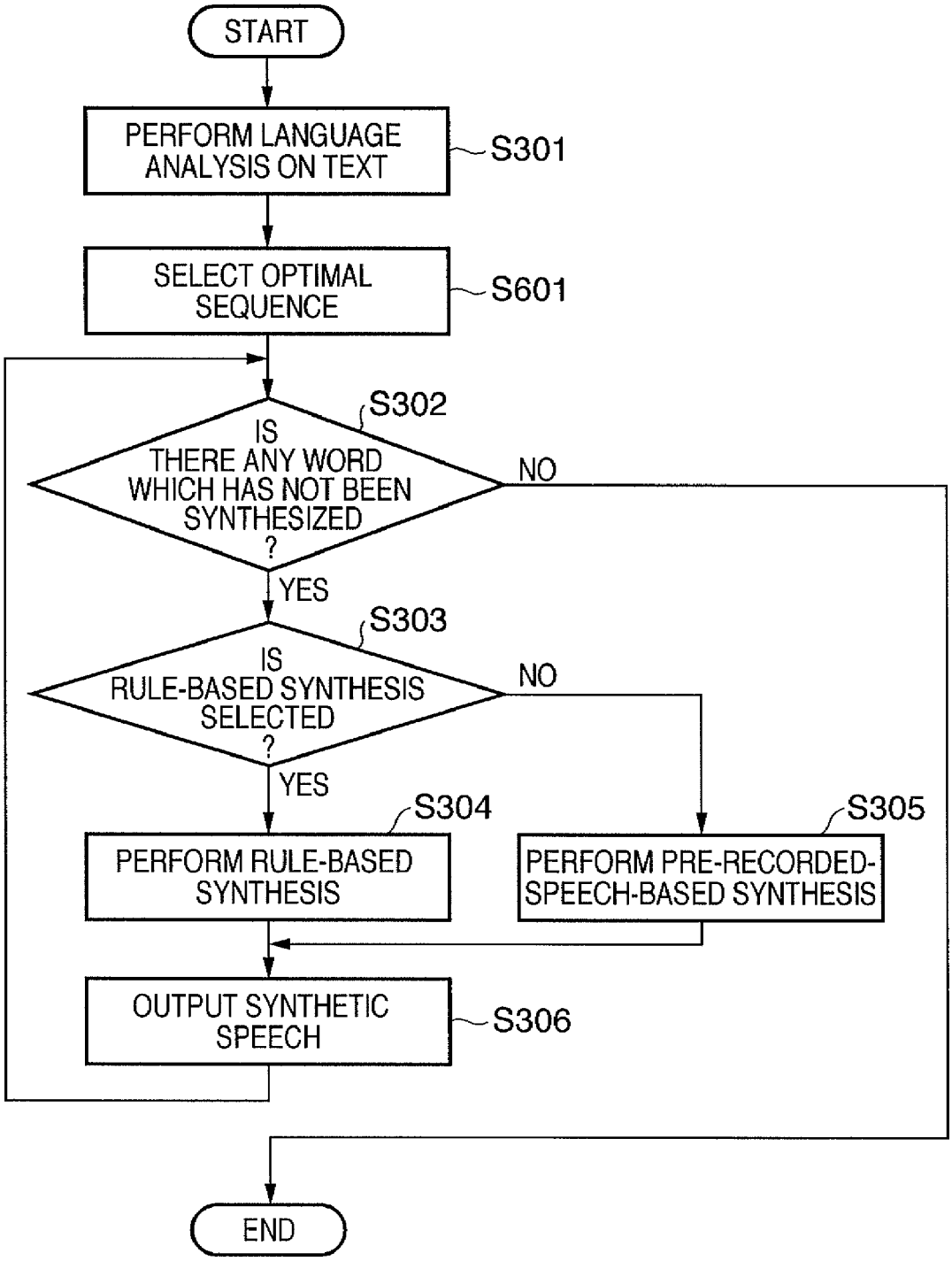
FIG. 6 is a flowchart showing processing in a speech synthesis apparatus according to the third embodiment.

FIG. 6 is a flowchart showing processing in the speech synthesis apparatus according to this embodiment. The same reference numerals as in FIG. 6 denote the same steps in FIG. 3. Note that the arrangement in FIG. 2 refers to the module arrangement of the speech synthesis apparatus of this embodiment.

Referring to FIG. 6, in step S301, a language processing unit 202 constructs a word lattice by consulting a language dictionary 212 for a text as a synthesis target held by a text holding unit 201. In addition, the language processing unit 202 adds a pronunciation to each word and extracts, from pre-recorded-speech-based synthesis data 207, information indicating whether there is pre-recorded speech corresponding to each word. This embodiment differs from the first embodiment in that an analysis result contains a plurality of solutions. An analysis result holding unit 203 holds the analysis result. The process then shifts to step S601.

In step S601, a synthesis selection unit 209 selects an optimal sequence of synthesis candidate speech data which satisfy a selection criterion for all or part of a text based on the analysis result held by the analysis result holding unit 203. A selection result holding unit 210 holds the selected optimal sequence. The process then shifts to step S302.

Assume that the selection criterion adopted by the synthesis selection unit 209 is "to minimize the sum of the number of times of switching of speech synthesis methods and the number of times of concatenation of synthesis candidate speech".

If it is determined in step S302 that the optimal sequence held by the selection result holding unit 210 contains a word which has not been synthesized, the process shifts to step S303. If there is no word which has not been synthesized, this processing is terminated.

In step S303, the synthesis selection unit 209 causes the processing to be applied to a word of interest to branch to step S304 or step S305 based on the optimal sequence held by the selection result holding unit 210. If rule-based synthesis is selected for the word of interest, the process shifts to step S304. If pre-recorded-speech-based synthesis is selected for the word of interest instead of rule-based synthesis, the process shifts to step S305. Since the processing in steps S304, S305, and S306 is the same as that in the first embodiment, a repetitive description will be omitted.

Figure 7:
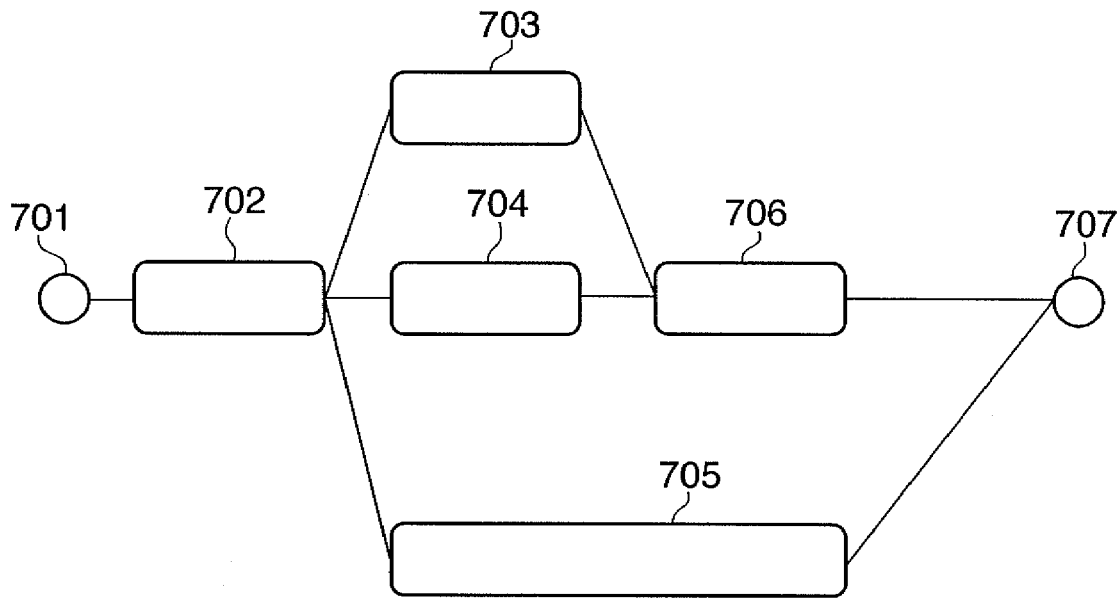
FIG. 7 is a schematic view for expressing a plurality of solutions as language analysis results in a lattice form in the third embodiment.

The selection of a plurality of solutions of a language analysis and an optical sequence will be described next with reference to FIGS. 7 and 8. FIG. 7 is a schematic view expressing a plurality of solutions as language analysis results in this embodiment in a lattice form.

Referring to FIG. 7, reference numeral 701 denotes a node representing the start of the lattice; and 707, a node representing the end of the lattice. Reference numerals 702 to 706 denote word candidates. In this case, there are word sequences conforming to the following three solutions:

(1) 702-703-706
(2) 702-704-706
(3) 702-705

Figure 8:
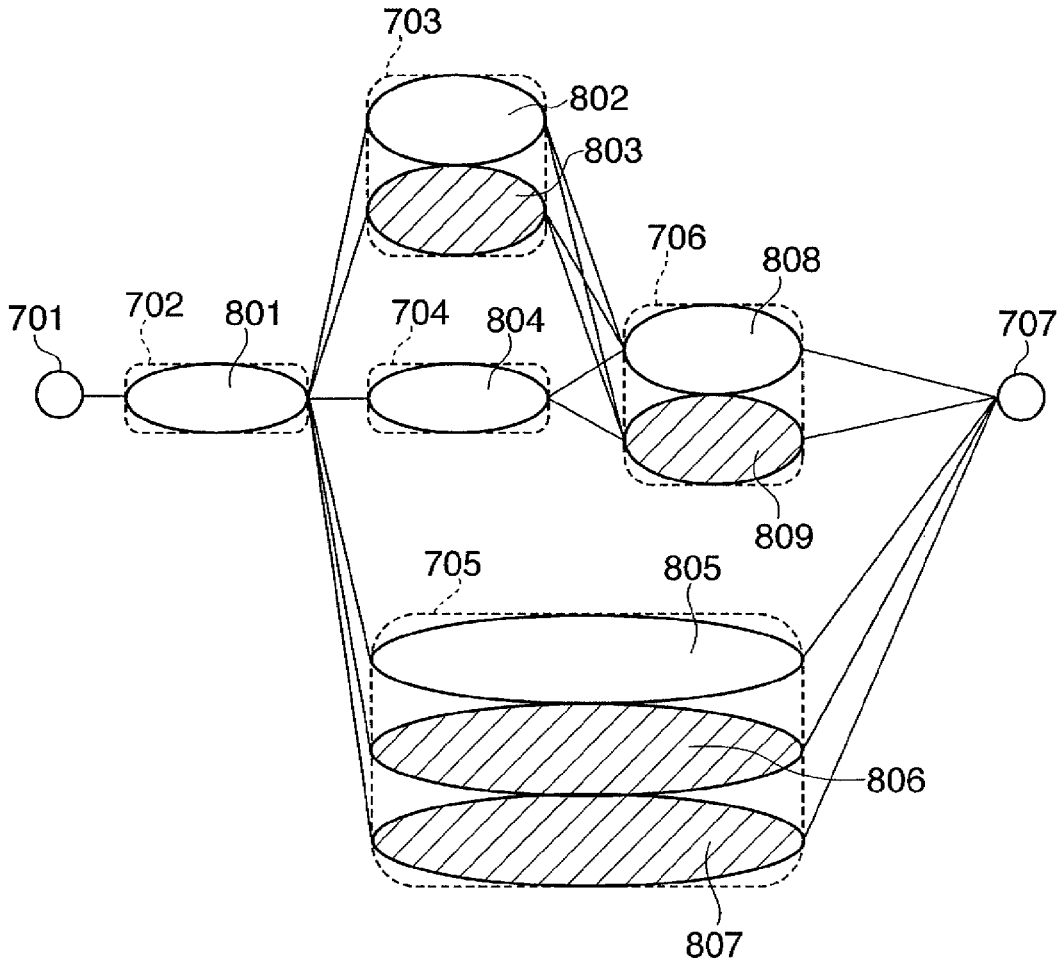
FIG. 8 is a schematic view expressing the word candidates in FIG. 7 converted into synthesis candidate speech data in a lattice form.

FIG. 8 is a schematic view expressing the word candidates in FIG. 7 converted into synthesis candidate speech data in a lattice form.

Referring to FIG. 8, reference numerals 801 to 809 denote synthesis candidate speech data. Among the synthesis candidate speech data, the data indicated by the ellipses 801, 802, 804, 805, and 808 without hatching are synthesis candidate speech data obtained by applying rule-based synthesis to the pronunciations of the words registered in the language dictionary 212. On the other hand, the hatched ellipses 803, 806, 807, and 809 are synthesis candidate speech data obtained by applying pre-recorded-speech-based synthesis to the pre-recorded speech registered in the pre-recorded-speech-based synthesis data 207. Since no pre-recorded speech data corresponding to the pre-recorded-speech-based synthesis data 207 is registered in the candidates 702 and 704, there is no synthesis candidate speech based on pre-recorded-speech-based synthesis. Referring to FIG. 8, the word candidates shown in FIG. 7 are indicated by the broken lines with the same reference numerals as in FIG. 7 denoting the same word candidates.

The example shown in FIG. 8 includes the following nine sequences of synthesis candidate speech data:

(1) 801-802-808
(2) 801-802-809
(3) 801-803-808
(4) 801-803-809
(5) 801-804-808
(6) 801-804-809
(7) 801-805
(8) 801-806
(9) 801-807

As is understood, each of these sequences of synthesis candidate speech data represents a selection pattern of speech synthesis methods in consideration of the presence/absence of pre-recorded speech data of each word. This embodiment selects one of obtained selection patterns which minimizes the sum of the number of times of switching of the speech synthesis methods and the number of times of concatenation of words. In this case, the sequence "(7) 801-805" minimizes the sum of the number of times of switching of the speech synthesis methods and the number of times of concatenation of words. The synthesis selection unit 209 therefore selects the sequence "801-805".

Fourth Embodiment

A general user dictionary function of speech synthesis registers pairs of spellings and pronunciations in a user dictionary. A speech synthesis apparatus having both the rule-based synthesis function and the pre-recorded-speech-based synthesis function as in the present invention preferably allows a user to register pre-recorded speech in addition to pronunciations. It is further preferable to register a plurality of pre-recorded speech data. Consider a case in which this embodiment is provided with a user dictionary function capable of registering any of combinations of spellings and pronunciations, spellings and pre-recorded speech, and spellings, pronunciations, and pre-recorded speech. A pronunciation registered by the user is converted into synthetic speech by using rule-based synthesis. In addition, pre-recorded speech registered by the user is converted into synthetic speech by using pre-recorded-speech-based synthesis.

Assume that in this embodiment, when there is pre-recorded speech registered in the system, synthetic speech obtained by using pre-recorded-speech-based synthesis is selected. Assume also that if there is no pre-recorded speech registered in the system, synthetic speech obtained by applying rule-based synthesis to a pronunciation is selected.

Pre-recorded speech registered by the user does not always have high quality depending on a recording environment. Some contrivance is therefore required to select the synthetic speech of a word registered by the user. A method of selecting the synthetic speech of a word registered by the user by using information about speech synthesis methods for preceding and succeeding words will be described.

Figure 9:
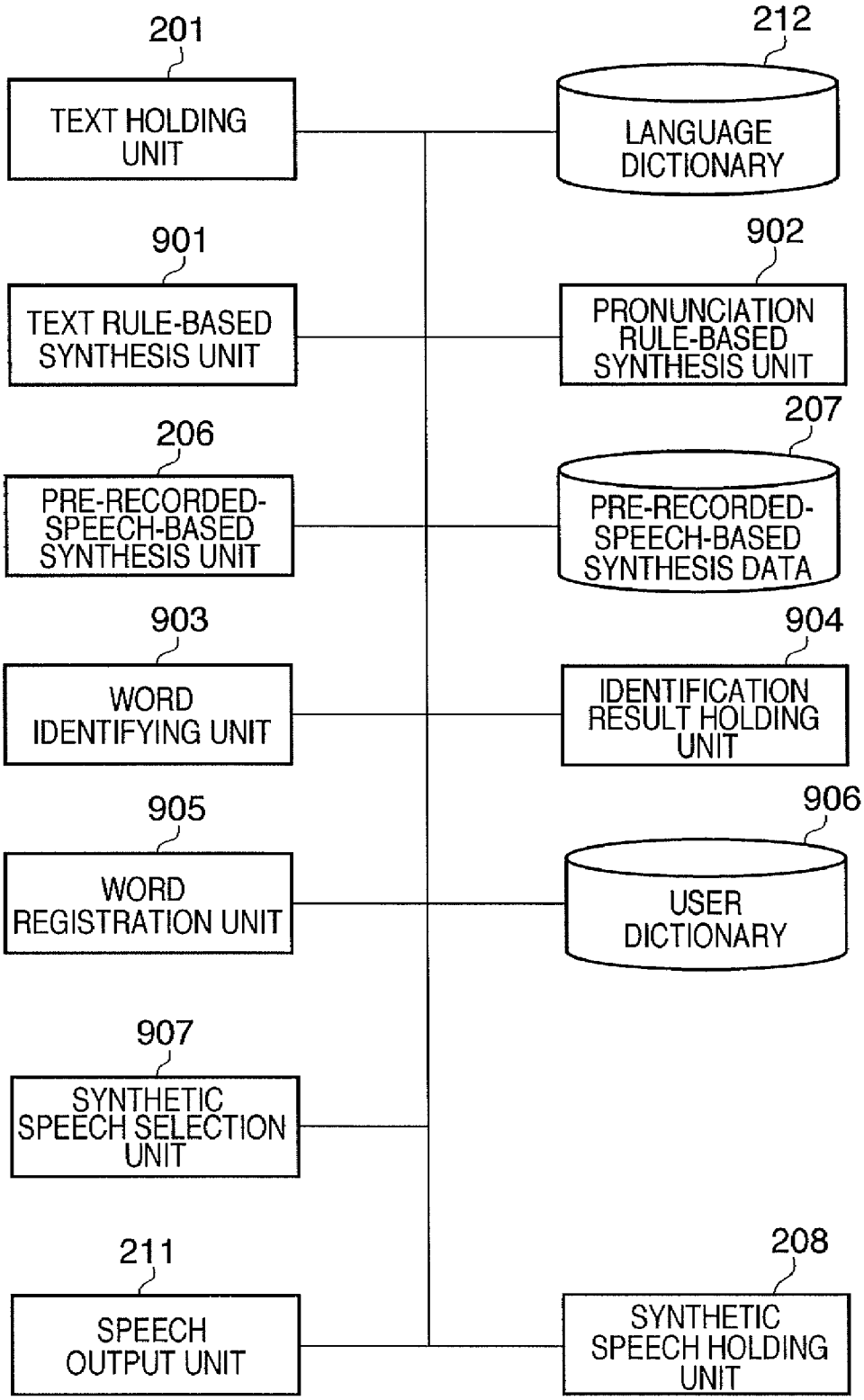
FIG. 9 is a block diagram showing the module arrangement of a speech synthesis apparatus according to the fourth embodiment.

FIG. 9 is a block diagram showing the module arrangement of the speech synthesis apparatus according to this embodiment. The same reference numerals as in FIG. 9 denote modules which perform the same processing as that in the first embodiment in FIG. 2.

A text holding unit 201 holds a text as a speech synthesis target. A text rule-based synthesis unit 901 performs language analysis on the spelling of an unknown word (to be described later) held by an identification result holding unit 904 by using words whose pronunciations are registered in a language dictionary 212 and user dictionary 906, and then performs rule-based synthesis based on the language analysis result. The text rule-based synthesis unit 901 then output the synthetic speech. A pronunciation rule-based synthesis unit 902 receives a pronunciation registered in the user dictionary 906, performs rule-based synthesis, and outputs the synthetic speech. A pre-recorded-speech-based synthesis unit 206 performs pre-recorded-speech-based synthesis for one of the word identification results held by the identification result holding unit 904 which is identified as a word by using pre-recorded-speech-based synthesis data 207, and outputs the synthetic speech. The pre-recorded-speech-based synthesis data 207 holds the pronunciations and pre-recorded speech of words and phrases.

A word identifying unit 903 identifies a word of the text held by the text holding unit 201 by using the spellings of pre-recorded speech data registered in the pre-recorded-speech-based synthesis data 207 and user dictionary 906. The identification result holding unit 904 holds the word identification result. A word identification result may contain a character string (to be referred to as an unknown word in this embodiment) which is not registered in either the pre-recorded-speech-based synthesis data 207 or the user dictionary 906. A word registration unit 905 registers, in the user dictionary 906, the spellings and pronunciations input by the user via an input device 105.

The word registration unit 905 registers, in the user dictionary 906, the pre-recorded speech input by the user via a speech input device 109 and the spellings input by the user via the input device 105. The user dictionary 906 can register any of combinations of spellings and pronunciations, spellings and pre-recorded speech, and spellings, pronunciations, and pre-recorded speech. When the word registered in the user dictionary 906 is present in the identification result holding unit 904, a synthetic speech selection unit 907 selects the synthetic speech of a word of interest in accordance with a selection criterion. The speech output unit 211 outputs the synthetic speech held by a synthetic speech holding unit 208. The synthetic speech holding unit 208 holds the synthetic speech data respectively output from the text rule-based synthesis unit 901, the pronunciation rule-based synthesis unit 902, and the pre-recorded-speech-based synthesis unit 206.

Processing in the speech synthesis apparatus according to this embodiment will be described next with reference to FIG. 10.

Figure 10:
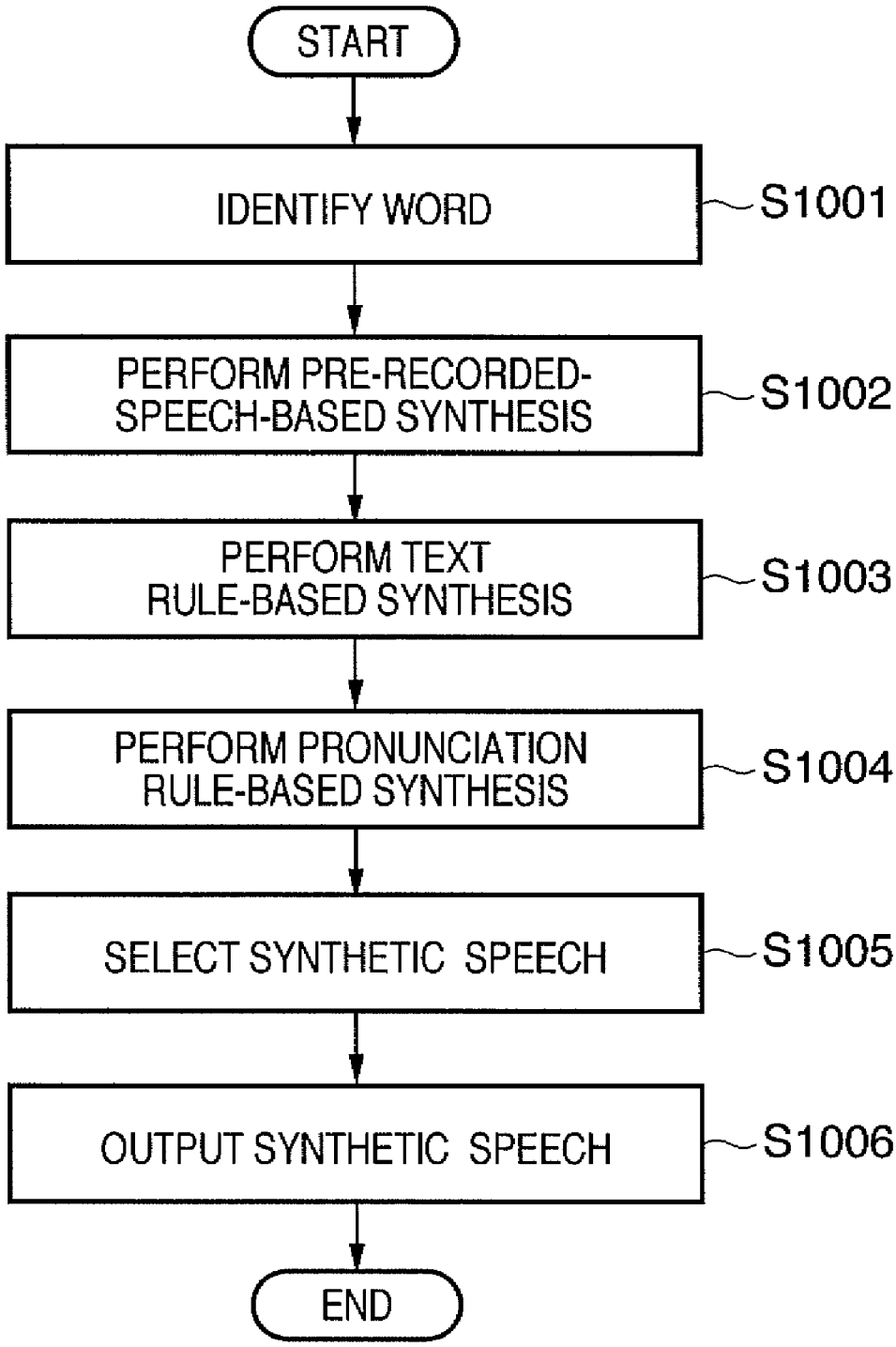
FIG. 10 is a flowchart showing processing in the speech synthesis apparatus according to the fourth embodiment.

Referring to FIG. 10, in step S1001, the word identifying unit 903 identifies a word of the text held by the text holding unit 201 by using the spellings of pre-recorded speech data registered in the pre-recorded-speech based synthesis data 207 and user dictionary 906. The identification result holding unit 904 holds, as an unknown word, the character string of a word which cannot be identified, together with identified words. The process then shifts to step S1002.

In step S1002, by using pre-recorded speech registered in the pre-recorded-speech-based synthesis data 207 and user dictionary 906, the pre-recorded-speech-based synthesis unit 206 performs pre-recorded-speech-based synthesis for one of the word identification results held by the identification result holding unit 904 which is identified as a word. The synthetic speech holding unit 208 holds the generated synthetic speech. The process then shifts to step S1003.

In step S1003, the text rule-based synthesis unit 901 performs language analysis on the spelling of an unknown word held by the identification result holding unit 904 by using words whose pronunciations are registered in the language dictionary 212 and user dictionary 906, and then performs rule-based synthesis based on the language analysis result. The synthetic speech holding unit 208 holds the generated synthetic speech. The process then shifts to step S1004.

In step S1004, the pronunciation rule-based synthesis unit 902 performs rule-based synthesis for a word, of the word identification results held by the identification result holding unit 904, whose pronunciation is registered in the user dictionary 906. The synthetic speech holding unit 208 holds the generated synthetic speech. The process then shifts to step S1005.

In step S1005, if a plurality of synthesis candidate speech data are present with respect to a word including an unknown word in the identification result holding unit 904, the synthetic speech selection unit 907 selects one of them. The selection result is reflected in the synthetic speech holding unit 208 (for example, the selected synthetic speech is registered, or synthetic speech which is not selected is deleted). The process then shifts to step S1006.

In step S1006, a speech output unit 211 sequentially outputs the synthetic speech data held by the synthetic speech holding unit 208 from the start of the text. This processing is then terminated.

Figure 11:
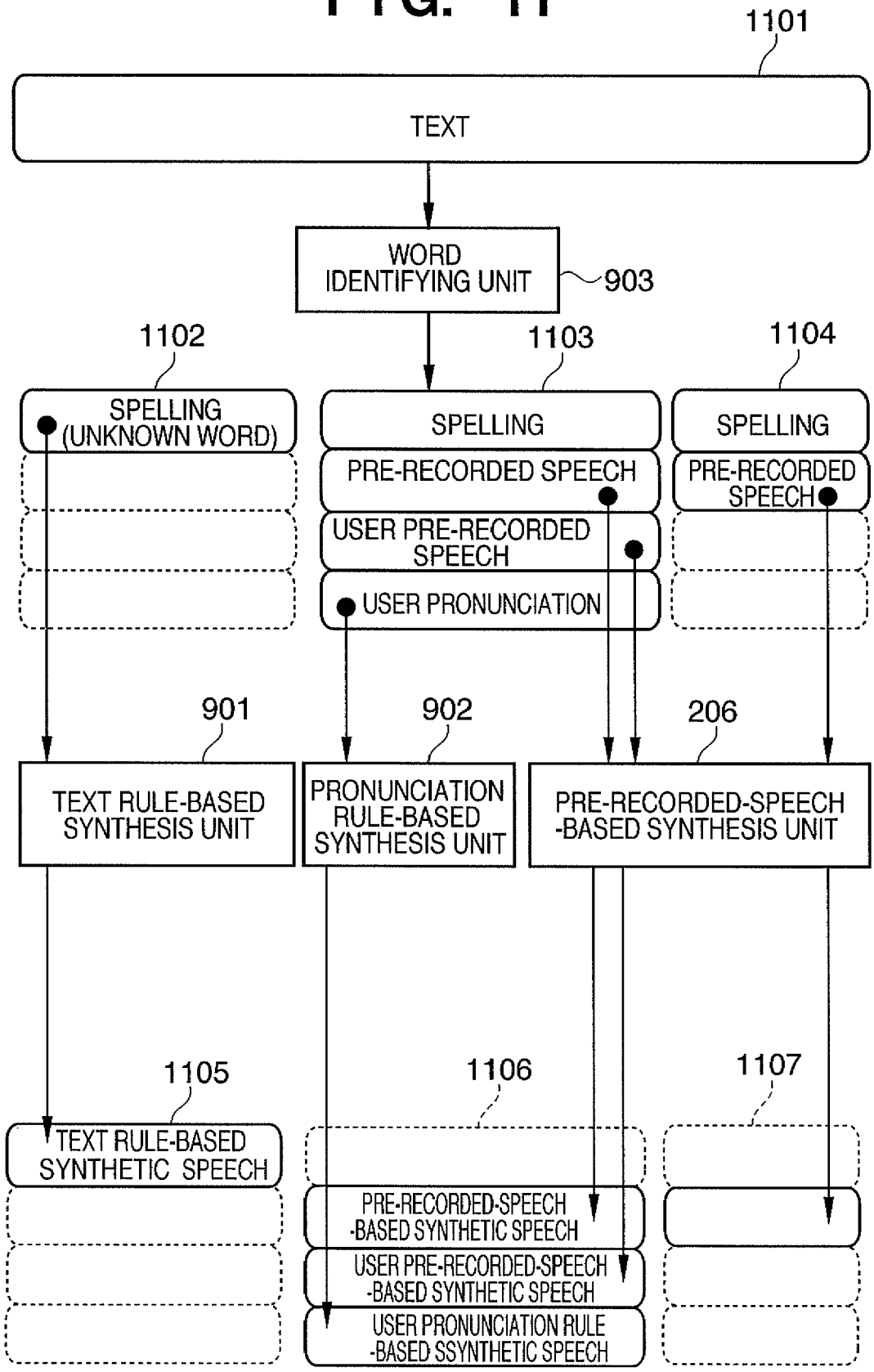
FIG. 11 is a schematic view showing a state at the finish time of step S1004 in the fourth embodiment.

FIG. 11 is a schematic view showing a state at the finish time of step S1004 described above.

Referring to FIG. 11, each data is represented by a rectangle with rounded corners, and each processing module is represented by a normal rectangle. Reference numeral 1101 denotes a text held by the text holding unit 201; and 1102 to 1104, the results obtained by performing word identification for the text 1101. The result 1102 is an unknown word, and the results 1103 and 1104 are words registered in the pre-recorded-speech-based synthesis data 207. The result 1103 is also the word whose pronunciation and pre-recorded speech are registered in the user dictionary. The result 1104 is a word registered in only the pre-recorded-speech-based synthesis data 207.

Reference numerals 1105, 1106, and 1107 denote synthetic speech data obtained as the results of speech synthesis processing up to step S1004. The synthetic speech 1105 corresponds to the unknown word 1102, and comprises only text rule-based synthetic speech. The synthetic speech 1106 corresponds to the word 1103, and comprises pre-recorded-speech-based synthetic speech, user pre-recorded-speech-based synthetic speech, and user pronunciation rule-based synthetic speech. The synthetic speech 1107 corresponds to the word 1104, and comprises only pre-recorded-speech-based synthetic speech.

The text rule-based synthesis unit 901 outputs text rule-based synthetic speech. The pronunciation rule-based synthesis unit 902 outputs user pronunciation rule-based synthetic speech. The pre-recorded-speech-based synthesis unit 206 outputs pre-recorded-speech-based synthetic speech and user pre-recorded-speech-based synthetic speech.

Figure 12:
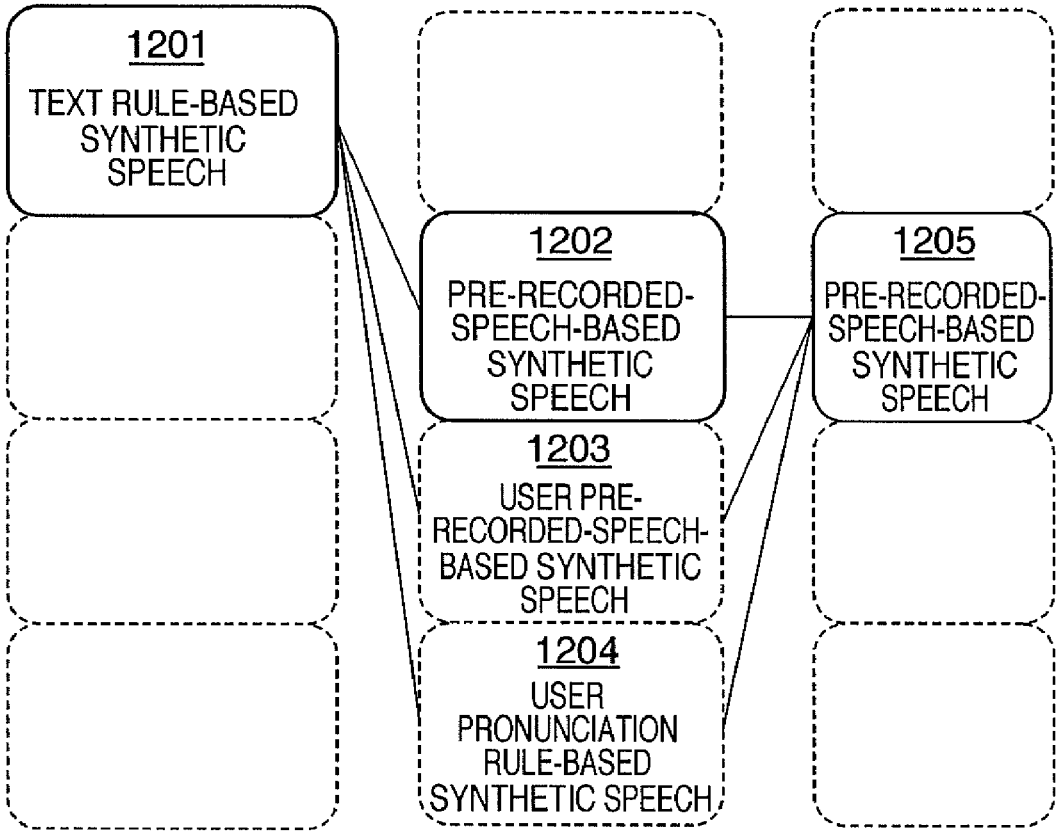
FIG. 12 is a schematic view showing synthesis candidate speech data obtained as the result of speech synthesis processing up to step S1004 in the fourth embodiment.

FIG. 12 is a schematic view showing the details of synthetic speech obtained as the result of speech synthesis processing up to step S1004.

The processing in step S1005 will be described with reference to FIG. 12. Referring to FIG. 12, reference numeral 1201 denotes text rule-based synthetic speech; 1202, pre-recorded-speech-based synthetic speech; 1203, user pre-recorded-speech-based synthetic speech; 1204, user pronunciation rule-based synthetic speech; and 1205, pre-recorded-speech-based synthetic speech. Assume that in this embodiment, the speech 1201 and the speech 1205 are present before and after a word of interest, and no other types of synthesis candidate speech data are present.

The synthetic speech selection unit 907 selects one of the pre-recorded-speech-based synthetic speech 1202, user pre-recorded-speech-based synthetic speech 1203, and user pronunciation rule-based synthetic speech 1204 which satisfies a selection criterion.

Consider a case in which the selection criterion is "to give priority to the same or similar speech synthesis method as or to an immediately preceding speech synthesis method". In this case, since the immediately preceding speech synthesis method is text rule-based synthesis, the user pronunciation rule-based synthetic speech 1204 which is a kind of speech based on rule-based synthesis is selected.

If the selection criterion is "to give priority to the same or similar speech synthesis method as or to an immediately succeeding speech synthesis method", the pre-recorded-speech-based synthetic speech 1202 is selected.

As described above, providing the function of registering a pronunciation and pre-recorded speech in a user dictionary in correspondence with the spelling of each word will increase the number of choices for the selection of speech synthesis methods, thus allowing to expect an improvement in intelligibility.

Fifth Embodiment

The fourth embodiment has exemplified the case in which there is only one synthesis candidate speech data before and after a word registered by the user. The fifth embodiment exemplifies a case in which words registered by the user are present consecutively.

Figure 13:
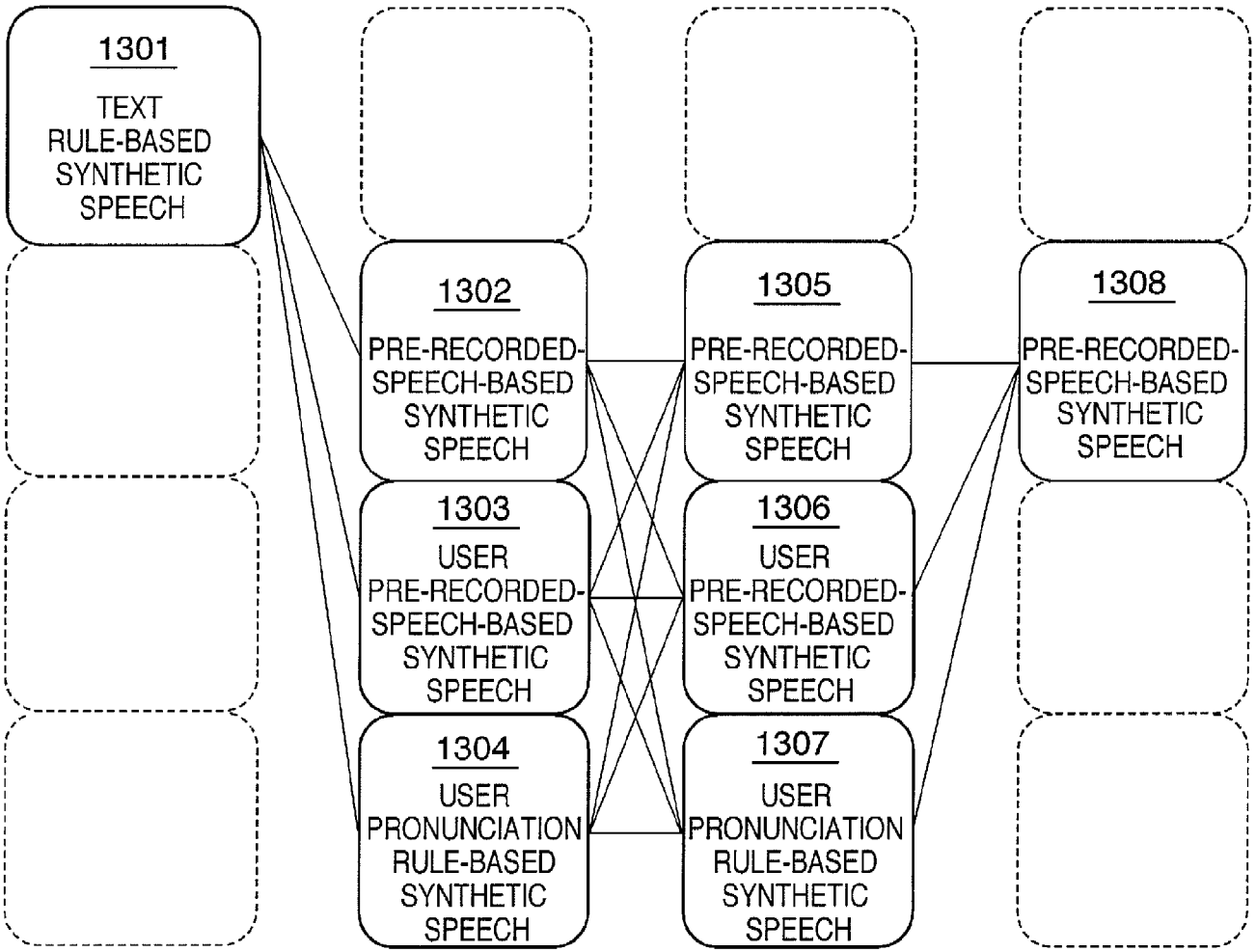
FIG. 13 is a schematic view showing synthesis candidate speech data in the fifth embodiment.

FIG. 13 is a schematic view expressing synthesis candidate speech data in the fifth embodiment.

Referring to FIG. 13, for two words 1301 and 1308 at the two ends, synthetic speech data which have already been selected are determined. Reference numeral 1302 to 1307 denote synthesis candidate speech data corresponding to a word registered by the user.

As in the fourth embodiment, a synthetic speech selection unit 907 selects one synthetic speech data from synthesis candidate speech data in accordance with a predetermined selection criterion. If, for example, the selection criterion is "to minimize the number of times of switching of speech synthesis methods and give priority to pre-recorded-speech-based synthetic speech", 1301-1302-1305-1308 is selected. If the selection criterion is "to give priority to user pre-recorded-speech-based synthetic speech and minimize the number of times of switching of speech synthesis methods", 1301-1303-1306-1308 is selected.

Considering the probability that the voice quality of pre-recorded speech registered by the user is unstable, it is also effective to use the selection criterion "to minimize the sum total of concatenation distortion at concatenation points".

As described above, even if words registered by the user are present consecutively, an improvement in intelligibility can be expected by setting a selection criterion so as to implement full or partial optimization.

Sixth Embodiment

The first to fifth embodiments have exemplified the case in which a speech synthesis method is selected for a word of interest based on word information other than that of the word of interest. However, the present invention is not limited to this. The present invention can adopt an arrangement configured to select a speech synthesis method based on only the word information of a word of interest.

Figure 14:
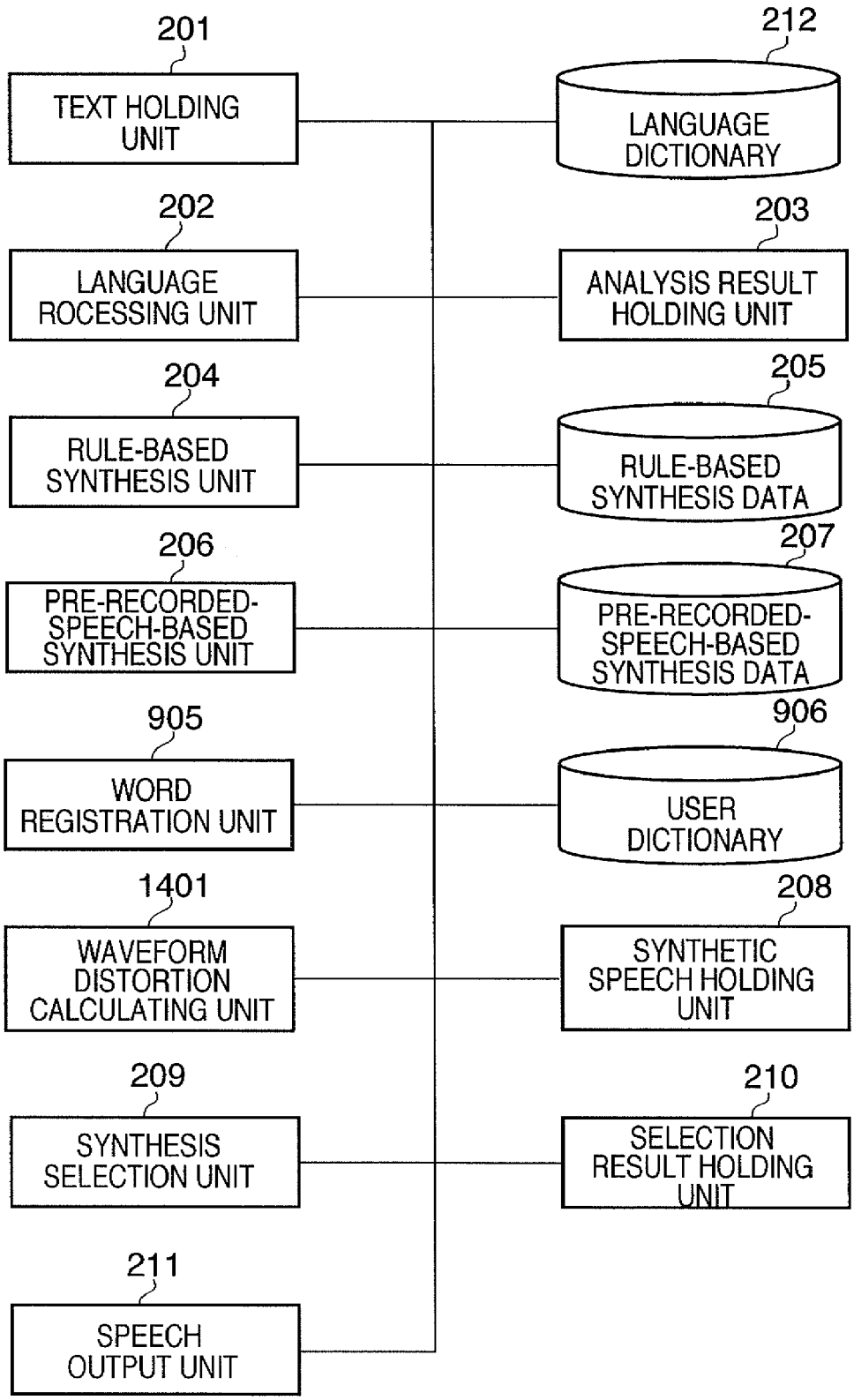
FIG. 14 is a block diagram showing the module arrangement of a speech synthesis apparatus according to the sixth embodiment.

FIG. 14 is a block diagram showing the module arrangement of a speech synthesis apparatus according to the sixth embodiment.

The same reference numerals as in FIG. 14 denote modules which perform the same processing in the first to fifth embodiments in FIGS. 2 to 9, and a repetitive description will be omitted. A waveform distortion calculating unit 1401 calculates waveform distortion (to be described later) between the synthesis candidate speech obtained by applying rule-based synthesis to a pronunciation registered in a language dictionary 212 and the synthesis candidate speech obtained by applying pre-recorded-speech-based synthesis to pre-recorded speech registered in a user dictionary 906. A synthesis selection unit 209 compares the waveform distortion obtained by the waveform distortion calculating unit 1401 with a preset threshold, and selects the word registered by the user regardless of speech synthesis methods for preceding and succeeding words when the waveform distortion is larger than the threshold.

Since a processing procedure in the sixth embodiment is the same as that in the first embodiment, the processing procedure in the sixth embodiment will be described with reference to FIG. 3.

The processing procedure in steps S301, S302, S304, S305, and S306 in FIG. 3 is the same as that in the first embodiment, and hence a repetitive description will be omitted.

In step S303, the waveform distortion calculating unit 1401 calculates the waveform distortion between the synthesis candidate speech obtained by applying rule-based synthesis to a pronunciation registered in the language dictionary 212 and the synthesis candidate speech obtained by applying pre-recorded-speech-based synthesis to pre-recorded speech registered in the user dictionary 906. The synthesis selection unit 209 then compares the waveform distortion obtained by the waveform distortion calculating unit 1401 with a preset threshold. If the waveform distortion is larger than the threshold, the synthesis selection unit 209 selects pre-recorded-speech-based synthesis regardless of speech synthesis methods for preceding and succeeding words. The process then shifts to step S305; otherwise, the process shifts to step S304.

As waveform distortion, a value based on a known technique, e.g., the sum total of the differences between the amplitudes of waveforms at the respective time points or the sum total of spectral distances, can be used. Alternatively, waveform distortion can be calculating by using dynamic programming or the like upon establishing a temporal correlation between two synthesis candidate speech data.

As described above, introducing waveform distortion makes it possible to give priority to user's intention of the registration of pre-recorded speech (more than a simple intention to increase variations, e.g., the intention to make a word be pronounced according to registered pre-recorded speech).

Seventh Embodiment

The sixth embodiment has exemplified the case in which a speech synthesis method is selected for a word of interest in consideration of the waveform distortion between the synthesis candidate speech obtained by applying rule-based synthesis to a pronunciation registered in the language dictionary 212 and the synthesis candidate speech obtained by applying pre-recorded-speech-based synthesis to pre-recorded speed registered in the user dictionary 906. However, targets for which waveform distortion is to be obtained are not limited to them. That is, it suffices to pay attention to the waveform distortion between the synthesis candidate speech based on a pronunciation or pre-recorded speed registered in the system and the synthesis candidate speech based on a pronunciation or pre-recorded speech registered in the user dictionary. In this case, if the waveform distortion is larger than a threshold, priority is given to the synthesis candidate speech based on the pronunciation or pre-recorded speech registered in the user dictionary.

Eighth Embodiment

The first and second embodiments have exemplified the case in which when a speech synthesis method is to be selected for each word, a text is processed starting from its start word. However, the present invention is not limited to this, and can adopt an arrangement configured to process a text starting from its end word. When a text is to be processed starting from its end word, a speech synthesis method is selected for a word of interest based on a speech synthesis method for an immediately succeeding word. In addition, the present invention can adopt an arrangement configured to process a text starting from an arbitrary word. In this case, a speech synthesis method is selected for a word of interest based on already selected speech synthesis methods for preceding and succeeding words.

Ninth Embodiment

The first to third embodiments have exemplified the case in which the language processing unit 202 divides a text into words by using the language dictionary 212. However, the present invention is not limited to this. For example, the present invention can incorporate an arrangement configured to identify words by using words and phrases included in a language dictionary 212 and pre-recorded-speech-based synthesis data 207.

Figure 15:
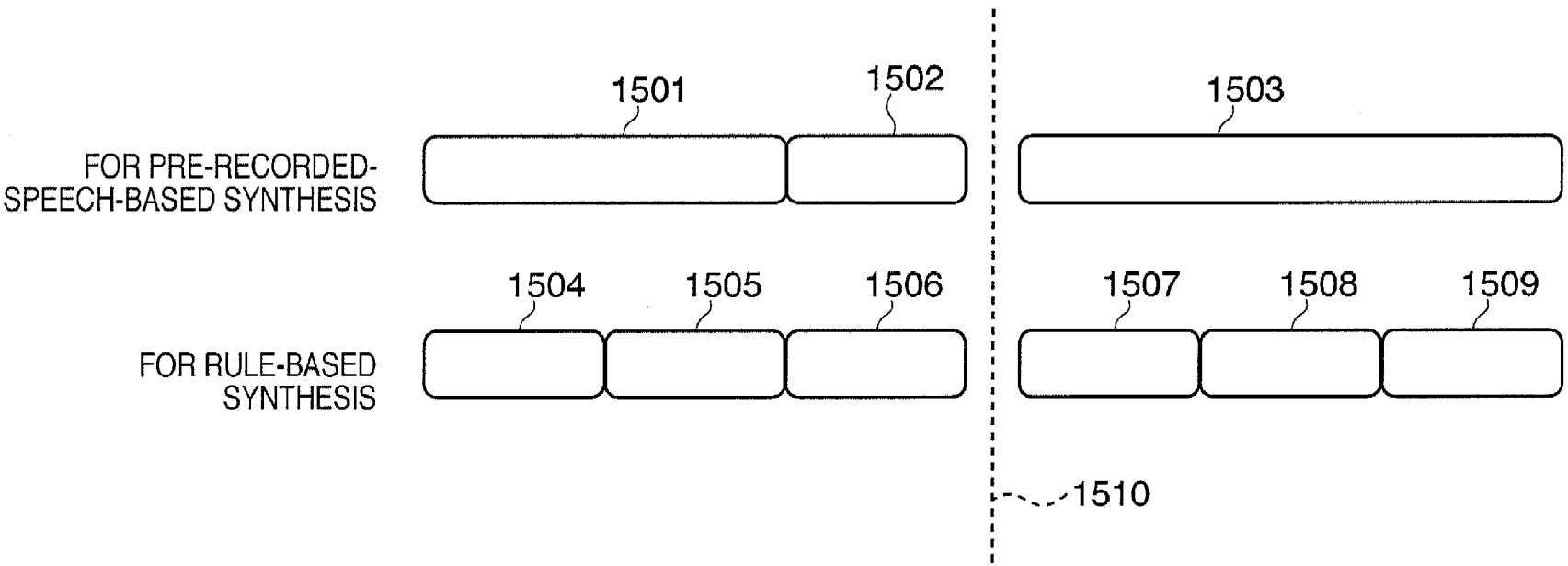
FIG. 15 is a schematic view showing language analysis results in the ninth embodiment.

FIG. 15 is a schematic view showing the result obtained by making a language processing unit 202 divide a text into words or phrases by using words and phrases included in the language dictionary 212 and pre-recorded-speech-based synthesis data 207. Referring to FIG. 15, reference numerals 1501 to 1503 denote the identification results based on words and phrases included in the pre-recorded-speech-based synthesis data 207 for pre-recorded-speech-based synthesis. The results 1501 and 1503 indicate phrases each comprising a plurality of words. Reference numerals 1504 to 1509 denote identification results obtained by the language dictionary 212 for rule-based synthesis; and 1510, a position where speech synthesis processing is to be performed next.

If rule-based synthesis is selected in step S303 in FIG. 3, the words 1504 to 1509 are selected as a processing unit for speech synthesis. If pre-recorded-speech-based synthesis is selected, the phrases 1501 and 1503 or the word 502 is selected as a processing unit for synthesis. Assume that in the case shown in FIG. 15, speech synthesis processing has been complete up to the position 1510. In this case, speech synthesis processing is performed next for the phrase 1503 or the word 1507. When pre-recorded-speech-based synthesis is selected, a pre-recorded-speech-based synthesis unit 206 processes the phrase 1503. When the phrase 1503 is processed, the words 1507 to 1509 are excluded from selection targets in step S302. Referring to FIG. 15, this operation is equivalent to moving the dotted line 1510 indicating the position where speech synthesis processing is to be performed next backward from the phrase 1503 (word 1509).

If rule-based synthesis is selected, a rule-based synthesis unit 204 processes the word 1507. When the word 1507 is processed, the phrase 1503 is excluded from selection targets in step S302, and the word 1508 is processed next. Referring to FIG. 15, this operation is equivalent to moving the dotted line 1510 indicating the position where speech synthesis processing is to be performed next backward from the word 1507.

As described above, when the result obtained by performing language analysis by using words and phrases included in the language dictionary 212 and pre-recorded-speech-based synthesis data 207 is to be used, it is necessary to proceed with processing while establishing correspondence between phrases and corresponding words.

When the language dictionary 212 is to be generated, incorporating the information of the words and phrases of the pre-recorded-speech-based synthesis data 207 in the language dictionary 212 makes it unnecessary for the language processing unit 202 to access the pre-recorded-speech-based synthesis data 207 at the time of execution of language analysis.

10th Embodiment

According to the first embodiment, the selection criterion for speech synthesis methods is "to preferentially select the same speech synthesis method as that selected for an immediately preceding word". However, the present invention is not limited to this. It suffices to use another selection criterion or combine the above selection criterion with an arbitrary selection criterion.

For example, the selection criterion "to reset a speech synthesis method at a breath group" is combined with the above selection criterion to set the selection criterion "to select the same speech synthesis method as that selected for an immediately preceding word but to give priority to the pre-recorded-speech-based synthesis method upon resetting the speech synthesis method at a breath group". Information indicating whether a breath group is detected is one piece of word information obtained by language analysis. That is, a language processing unit 202 includes a unit configured to determine whether each identified word corresponds to a breath group.

In the case of the selection criterion in the first embodiment, when rule-based synthesis is selected, this method is basically kept selected up to the end of the processing. In contrast to this, in the case of the above combination of selection criteria, since the selection is reset at a breath group, the pre-recorded-speech-based synthesis method can be easily selected. It is therefore possible to expect an improvement in voice quality. Note that switching of the speech synthesis methods at a breath group has almost no influence on intelligibility.

11th Embodiment

The second embodiment has exemplified the case in which one pre-recorded speech data corresponds to a word of interest. However, the present invention is not limited to this, and a plurality of pre-recorded speech data can exist. In this case, the concatenation distortion between the synthesis candidate speech obtained by applying rule-based synthesis to the pronunciation of a word and immediately preceding synthetic speech and the concatenation distortion between the synthesis candidate speech obtained by applying pre-recorded-speech-based synthesis to a plurality of pre-recorded speech data and the immediately preceding synthetic speech are calculated. Among these synthesis candidate speech data, synthesis candidate speech exhibiting the minimum concatenation distortion is selected. Preparing a plurality of pre-recorded speech data for one word is an effective method from the viewpoint of versatility and a reduction in concatenation distortion.

12th Embodiment

In the third embodiment, the selection criterion is "to minimize the sum of the number of times of switching of speech synthesis methods and the number of times of concatenation of synthesis candidate speech". However, the present invention is not limited to this. For example, it suffices to use a known selection criterion such as a criterion for concatenation distortion minimization like that used in the second embodiment or introduce an arbitrary selection criterion.

13th Embodiment

The fourth embodiment has exemplified the case in which when pre-recorded-speech-based synthetic speech exists, text rule-based synthetic speech is not set as synthesis candidate speech, as shown in FIG. 11. However, the present invention is not limited to this. In the data 1106 in FIG. 11, text rule-based synthetic speech may further exist as synthesis candidate speech. In this case, it is necessary to perform text rule-based synthesis for a word other than an unknown word in step S1003 (see FIG. 10).

Other Embodiments

Note that the present invention can be applied to an apparatus comprising a single device or to system constituted by a plurality of devices.

Furthermore, the invention can be implemented by supplying a software program, which implements the functions of the foregoing embodiments, directly or indirectly to a system or apparatus, reading the supplied program code with a computer of the system or apparatus, and then executing the program code. In this case, so long as the system or apparatus has the functions of the program, the mode of implementation need not rely upon a program.

Accordingly, since the functions of the present invention can be implemented by a computer, the program code installed in the computer also implements the present invention. In other words, the claims of the present invention also cover a computer program for the purpose of implementing the functions of the present invention.

In this case, so long as the system or apparatus has the functions of the program, the program may be executed in any form, such as an object code, a program executed by an interpreter, or script data supplied to an operating system.

Example of storage media that can be used for supplying the program are a floppy disk, a hard disk, an optical disk, a magneto-optical disk, a CD-ROM, a CD-R, a CD-RW, a magnetic tape, a non-volatile type memory card, a ROM, and a DVD (DVD-ROM and a DVD-R).

As for the method of supplying the program, a client computer can be connected to a website on the Internet using a browser of the client computer, and the computer program of the present invention or an automatically-installable compressed file of the program can be downloaded to a recording medium such as a hard disk. Further, the program of the present invention can be supplied by dividing the program code constituting the program into a plurality of files and downloading the files from different websites. In other words, a WWW (World Wide Web) server that downloads, to multiple users, the program files that implement the functions of the present invention by computer is also covered by the claims of the present invention.

It is also possible to encrypt and store the program of the present invention on a storage medium such as a CD-ROM, distribute the storage medium to users, allow users who meet certain requirements to download decryption key information from a website via the Internet, and allow these users to decrypt the encrypted program by using the key information, whereby the program is installed in the user computer.

Besides the cases where the aforementioned functions according to the embodiments are implemented by executing the read program by computer, an operating system or the like running on the computer may perform all or a part of the actual processing so that the functions of the foregoing embodiments can be implemented by this processing.

Furthermore, after the program read from the storage medium is written to a function expansion board inserted into the computer or to a memory provided in a function expansion unit connected to the computer, a CPU or the like mounted on the function expansion board or function expansion unit performs all or a part of the actual processing so that the functions of the foregoing embodiments can be implemented by this processing.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-065780, filed Mar. 14, 2007, which is hereby incorporated by reference herein in its entirety.

What is claimed is:

1. A speech synthesis apparatus comprising:

a processor configured to function as:

a language analysis unit configured to identify a word by performing language analysis on a supplied text;

a rule-based synthesis unit configured to perform a rule-based synthesis using a language dictionary for the identified word;

a pre-recorded-speech-based synthesis unit configured to perform a pre-recorded-speech-based synthesis using a user dictionary;

a calculation unit configured to calculate a waveform distortion between a first synthesized speech obtained by a plyin the rule-based synthesis to a pronunciation registered in the language dictionar and a second s nthesized speech obtained by applying the pre-recorded-speech-based synthesis to pre-recorded speech registered in the user dictionary;

a comparison unit configured to compare the calculated waveform distortion with a threshold; and an output unit configured to output the second synthesized speech when the calculated waveform distortion is larger than the threshold, and output the first synthesized speech when the calculated waveform distortion is less than or equal to the threshold, wherein the user dictionar is s articular to a user, and the language dictionary is not particular to the user.

2. A speech synthesis method comprising:

a language analysis step of identifying a word by performing language analysis on a supplied text;

a rule-based synthesis step performing rule-based synthesis using a language dictionary for the identified word;

a pre-recorded-speech-based synthesis step performing pre-recorded-speech-based synthesis using a user dictionary;

a calculation step calculating a waveform distortion between a first synthesized speech obtained by applying the rule-based synthesis to a pronunciation reistered in the language dictionary and a second synthesized speech obtained by applying the pre-recorded-speech-based synthesis to pre-recorded speech registered in the user dictionary;

a comparison step comparing the calculated waveform distortion with a threshold; and an output step of outputting the second synthesized speech when the calculated waveform distortion is larger than the threshold, and outputting the first synthesized speech when the calculated waveform distortion is less than or equal to the threshold, wherein the user dictionary is particular to a user, and the language dictionary is not particular to the user.

3. A program stored on a non-transitory computer-readable medium that causes a computer to execute a speech synthesis method defined in claim 2.

4. A non-transitory computer-readable storage medium storing a program defined in claim 3.

* * * * *